United States Patent [19]

Johansson

[11] 4,254,516

[45] Mar. 10, 1981

[54] BATH TUBS

[76] Inventor: Hans A. V. Johansson, Trehäradsvägen 36, Eslöv, Sweden, S- 241 00

[21] Appl. No.: 41,020

[22] Filed: May 21, 1979

[30] Foreign Application Priority Data

May 26, 1978 [SE] Sweden ..... 7806055

[51] Int. Cl.[3] ..... A47K 3/00

[52] U.S. Cl. ..... 4/559

[58] Field of Search ..... 4/185 R, 185 HB, 173, 4/174, 175, 185 F, 185 S, 185 H, 150

[56] References Cited

U.S. PATENT DOCUMENTS

| | | | |
|---|---|---|---|
| 1,203,579 | 11/1916 | Callon | 4/150 |
| 1,261,758 | 4/1918 | Brown | 4/185 H |
| 1,704,639 | 3/1929 | Thompson | 4/185 H |
| 1,914,825 | 6/1933 | Ford | 4/185 H |
| 1,914,826 | 6/1933 | Ford | 4/185 H |
| 1,962,076 | 6/1934 | Jadkowski | 4/173 |
| 2,093,964 | 9/1937 | Hindle | 4/173 X |
| 2,269,420 | 1/1942 | Anderson et al. | 4/185 H |
| 2,564,190 | 8/1951 | Danielson | 4/173 |
| 2,756,439 | 7/1956 | Bollen | 4/185 H |
| 2,810,137 | 10/1957 | Olsson | 4/185 HB |
| 3,005,208 | 10/1961 | Matthews | 4/185 F |
| 3,210,775 | 10/1965 | Jongeneal | 4/185 HB |

*Primary Examiner*—Henry K. Artis

*Attorney, Agent, or Firm*—John J. Dennemeyer

[57] ABSTRACT

A bath tub, particularly for use by patients and old people, has a foot-rest 10 and back-rest 11 for partitioning its bathing space 7, and hand grips 12. The foot-rest 10 and the hand grips 12 are disposed within the bath tub 1 inside the outer rim 9 of the edge portions 8 of the tub and that the back-rest 11 is anchored outside the bathing space and projects outwardly therefrom, a narrow portion thereof extending in close relation to the outer rim 9 of the edge portion.

9 Claims, 4 Drawing Figures

BATH TUBS

The present invention relates to improvements in a bath tub, preferably for use in bath treatment of patients in sick-nursing and old-people-care activities, the bath tub being of a kind comprising a foot-rest and a back-rest for partitioning its bathing space, and at least one hand grip for a person.

A bath tub of the above kind is intended to facilitate stepping into and out of the bath tub, to provide an agreeable sitting comfort during bathing, and, whenever applicable, to facilitate the work carried out by bath attendants, and to give weak and motion-handicapped persons a feeling of security during bathing. Prior art bath tubs of this type fulfill most of the requirements with a good safety margin, but they are not designed so as to secure free space at the bath tub, so that mobile bath lifts or transport wagons can without obstruction be moved into positions close to the bath tub for transferring persons into and out of the latter.

The present invention has for its object to provide a free space about the outer edges of the bath tub so that mobile bath lifts or transport wagons can be moved without obstruction in close proximity to the bath tub.

This object is realised by the provision according to the invention of a bath tub of the kind comprising a foot-rest and a back-rest for partitioning its bathing space and at least one hand grip for a person bathing, wherein the foot-rest and the hand grip are disposed within the bath tub inside the outer rim of the edge portion of the bath tub, and the back-rest is anchored outside the bathing space and projects outwardly therefrom, extending with a narrow portion thereof in close relation to the outer rim of the edge portion.

The invention will now be described in more detail with reference to the accompanying drawings, in which.

Figure 1:
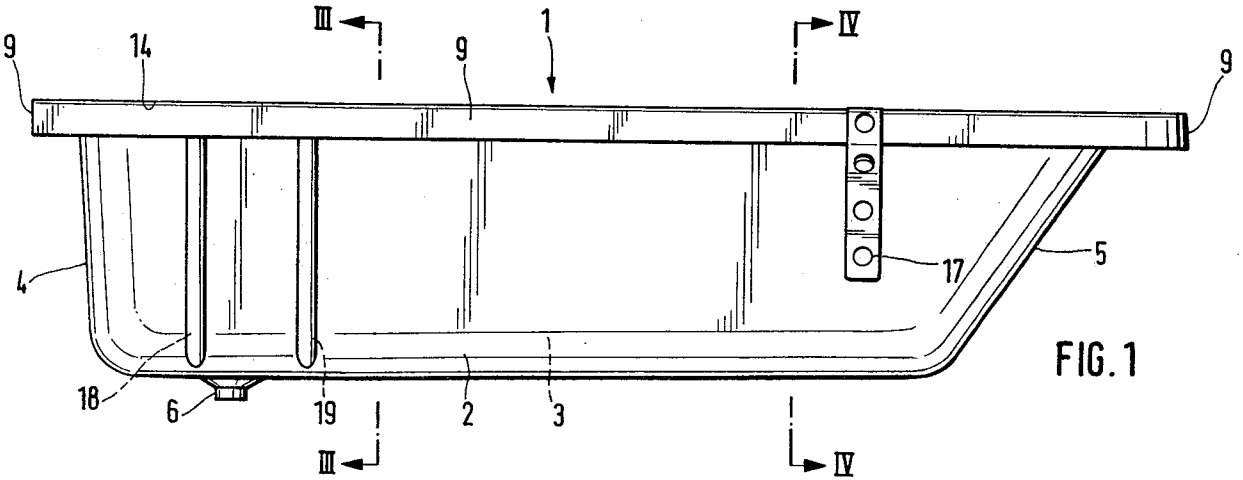
FIG. 1 is a side elevational view of a preferred bath tub according to the invention.
Figure 4:
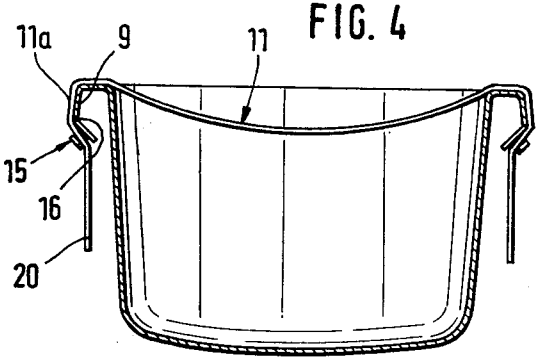
FIG. 4 is a cross-section taken along lines IV—IV in FIG. 1.
Figure 3:
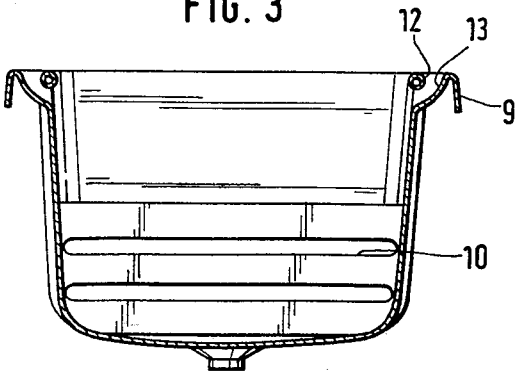
FIG. 3 is a cross-section taken along lines III—III in FIG. 1.
Figure 2:
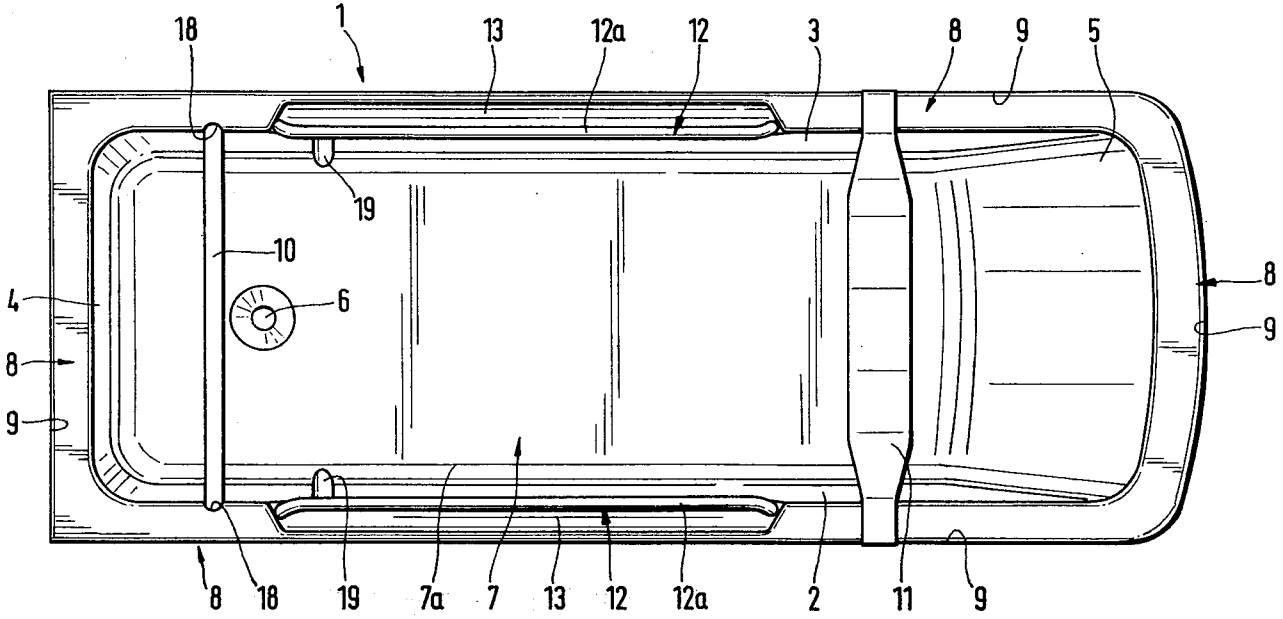
FIG. 2 is a plan view of the bath tub.

The bath tub 1 illustrated comprises longitudinally extending side walls 2 and 3, an end wall 4 at its foot-end and a rather steeply inclined end wall 5 at its head-end. The bath tub 1 has an outlet 6 which is connected to a waste pipe in a conventional way. Neither the drain pipe, water taps nor supporting elements for the bath tub 1 are shown on the drawings because such arrangements are well known and have no direct relation to the present invention.

The outlet 6 of the bath tub serves for discharging water from the bath space 7 which at its top is surrounded by edge portions 8, the rim of which is designated by numeral 9.

For partitioning the interior space 7 of the bath tub so as to form a smaller compartment 7*a* of suitable length, there is provided a foot-rest 10 limiting the smaller compartment 7*a* at one end and a back-rest 11 limiting the smaller compartment 7*a* at its opposite end. The bath tub 1 further includes two supporting hand grips or rails 12 for use of a person bathing.

In order not to obstruct mobile bath lifts (not shown) or other transport implements serving for conveying persons to and away from the bath tub 1, from being advanced close to and along the edge portions 8 of bath tub 1, the foot-rest 10 and hand grip 12 are disposed within the bath tub, inside the outer rim 9 of the edge portions 8 of the bath tub 1, and, in addition, the back-rest 11 is anchored outside the bathing compartment 7 and extends out of the latter, with a narrow portion 11*a* extending close to the outer rim 9 of the edge portion 8.

To enable convenient gripping possibilities, the hand grip 12 is elongated and extends adjacent the long side 2 and/or 3 of the bath tub 1 along a channel 13 formed in the edge portion 8 and with its gripping portion 12*a* spaced from the edge portion 8. The gripping portion 12*a* in addition suitably extends along the channel 13 at the portions thereof facing the bathing compartment 7 and is preferably disposed slightly outside the channel 13 and inside the bathing compartment 7.

In order to facilitate keeping both the hand grip 12 and channel 13 neat and clean, the surfaces defining the channel 13 are arcuate and substantially concentric about the longitudinal center line of the hand grip or rail 12.

In order that the hand grip shall not be obstructive to the bathing person, it is suitably anchored to the surfaces defining the channel member 13, and in order not to obstruct transport implements extending closely over the edge portion 8 the hand grip 12 is disposed beneath a horizontal plane tangent to the top side 14 of the edge portion 8. The hand grip 12 will be especially conveniently reachable for the bathing person if it extends along the major portion of the smaller compartment 7*a*.

The back-rest 11 can easily be anchored in a stable way without obstructing the movement of the transport arrangements adjacent the bath tub if it is anchored to fastening members 15 disposed on the outside of the edge portion 8 wholly or mainly inside a vertical plane tangent to the outer rim 9 of the edge portion 8. A fastening arrangement wherein the fastening members 15 are disposed on a part 16 of the edge portion 8 which is inclined at an oblique angle relative to the bathing compartment 7 is particularly simple. The back-rest 11 may suitably be a belt having two rows of holes 17 for hooking to the fastening members 15 with suitable stretch.

The foot-rest 10 may, like the back-rest 11, be detachably mounted, for instance by being extractable upwardly from engagement in grooves 18 or 19. By disposing such grooves at different localities in the bath tub 1, the foot-rest 10 can be mounted at various places for varying the partitioning of the bathing compartment 7. In order to enable the supporting handle 12 to be utilisable at its maximum, independently of which one of the grooves 18 or 19 is engaged by the foot-rest 10, the hand grip 12 may, as seen in a plan view, end in the region between the grooves 18 and 19.

The structural embodiments disclosed hereinbefore are merely intended to explain the invention, not to limit its scope. It may be mentioned, finally, that the fastening members 15 are suitably constituted by large headed pins anchored to the tub. Their head portions may be so oriented, preferably substantially parallel to the part 16 of the edge portion 8, as to enable the end portions 20 of the belts to hang down therefrom wholly beneath the edge portions 8 thereby preventing the same from hooking to the transport implements. Further, a plurality of fastening members may be disposed in rows at opposite sides of the bath tub, a plurality of back-rest members may be mounted, and such members may be mounted to be used as neck-rests or leg-rests.

What is claimed is:

1. A bathtub, particularly for use by patients and elderly persons, comprising:

a bathing compartment defined in part by opposing longitudinal side walls, a head-end wall, and a foot-end wall, said walls having upper edge portions;

a first set of mutually opposing generally vertical grooves disposed in said longitudinal side walls nearer said foot-end wall than said head-end wall;

a second set of mutually opposing generally vertical grooves disposed in said longitudinal side walls nearer said head-end wall than said first set of grooves;

a back rest detachably mountable near said head end;

a foot rest detachably mountable in either said first set or said second set of grooves; and a hand grip along at least one longitudinal side wall extending a major part of the length of the bathing compartment between the back rest and the first set of grooves and extending past the second set of grooves in the direction toward the foot end, said at least one longitudinal side wall having a depression in the upper edge portion thereof at least in the region of said second set of grooves, said hand grip being disposed in said depression to permit upward extraction of said foot rest from the second set of grooves without hindrance, whereby the bathtub is provided with at least one hand grip, and with a detachably mounted backrest and a detachably mounted footrest for adjustably partitioning the bathing compartment.

2. A bathtub as claimed in claim 1, wherein the footrest, when mounted, is situated substantially lower than the vertical midpoint of the bathing compartment.

3. A bathtub as claimed in claim 2, wherein the hand grip extends along a portion of said depression facing the bathing compartment and is disposed slightly outside said depression and inside the bathing compartment.

4. A bathtub as claimed in claim 3, wherein said depression is arcuate and substantially concentric about a longitudinal center line of the hand grip.

5. A bathtub as claimed in claim 4, wherein the hand grip is anchored to the upper edge portion of the longitudinal sidewall forming said depression.

6. A bathtub as claimed in claim 5, wherein the hand grip extends beneath a horizontal plane tangent to a top surface of the upper edge portion of the longitudinal sidewall.

7. A bathtub as claimed in claim 6, wherein the backrest is anchored to fastening members disposed on the outside of the upper edge portion of the longitudinal sidewalls, wholly or mainly inside a vertical plane tangent to an outer rim of the upper edge portions of the longitudinal sidewalls.

8. A bathtub as claimed in claim 7, wherein each said fastening member is disposed on a part of the upper edge portion of the respective longitudinal sidewall which is directed obliquely towards the bathing compartment.

9. A bathtub as claimed in claim 8, wherein the backrest comprises a belt having two rows of holes for hooking the belt onto fastening members disposed outside the bathing compartment.

* * * * *